US006843530B1

(12) United States Patent
Wu

(10) Patent No.: US 6,843,530 B1
(45) Date of Patent: Jan. 18, 2005

(54) MULTI-STAGE BACKREST ASSEMBLY

(76) Inventor: Yao-Chuan Wu, 1-1, Neipuzai, Daqi Cun, Min Xiung Hsiang, Jiayi Hsien (TW)

( * ) Notice: Subject to any disclaimer, the term of this patent is extended or adjusted under 35 U.S.C. 154(b) by 0 days.

(21) Appl. No.: 10/746,631

(22) Filed: Dec. 23, 2003

(51) Int. Cl.[7] ..... A47C 7/46
(52) U.S. Cl. ..... 297/284.4; 297/404; 297/284.3
(58) Field of Search ..... 297/284.1, 284.3, 297/284.4, 284.7, 353, 354.11, 391, 404, 408, 410

(56) References Cited

U.S. PATENT DOCUMENTS 3,059,971 A * 10/1962 Otto ..... 297/353
3,890,000 A * 6/1975 Easley ..... 297/284.4
4,732,423 A * 3/1988 Condon ..... 297/353
4,981,325 A * 1/1991 Zacharkow ..... 297/284.1
5,112,106 A * 5/1992 Asbjornsen et al. ..... 297/410
5,228,747 A * 7/1993 Greene ..... 297/284.3
5,505,520 A * 4/1996 Frusti et al. ..... 297/284.4
5,588,703 A * 12/1996 Itou ..... 297/284.4
5,704,689 A * 1/1998 Kim ..... 297/301.4
5,730,688 A * 3/1998 Prusick ..... 297/353
6,354,662 B1 * 3/2002 Su ..... 297/284.7
2002/0043841 A1 * 4/2002 Giacinto ..... 297/284.4

* cited by examiner

*Primary Examiner*—Peter R. Brown
(74) *Attorney, Agent, or Firm*—Alan D. Kamrath; Nikolai & Mersereau, P.A.

(57) ABSTRACT

A multi-stage backrest assembly includes a support frame, a back plate, a head plate, a waist plate, a first elastic swivel device, and two second elastic swivel devices. Thus, the multi-stage backrest assembly has a pivotable function so as to fit the curve of the user's body ergonomically, thereby providing a comfortable effect to the user.

20 Claims, 7 Drawing Sheets

MULTI-STAGE BACKREST ASSEMBLY

BACKGROUND OF THE INVENTION

1. Field of the Invention

The present invention relates to a multi-stage backrest assembly, and more particularly to a multi-stage backrest assembly for a chair.

2. Description of the Related Art

A conventional backrest 8 for a chair in accordance with the prior art shown in FIG. 7 comprises a main body 80 made of foam material and formed with a fixing plate 82 secured on a seat (not shown) for mounting the main body 80 of the backrest 8 to the seat. However, the conventional backrest 8 has a fixed structure and cannot be adjusted so as to fit the curve of the user's body ergonomically, so that the user easily feels uncomfortable during a long period of time.

SUMMARY OF THE INVENTION

The primary objective of the present invention is to provide a multi-stage backrest assembly having a pivotable function so as to fit the curve of the user's body ergonomically, thereby providing a comfortable effect to the user.

Another objective of the present invention is to provide a multi-stage backrest assembly, the waist plate is pivotable relative to the back plate so as to fit the user's waist and back ergonomically, thereby providing a comfortable effect to the user.

A flier objective of the present invention is to provide a multi-stage backrest assembly, wherein the crossbar of the head plate is pivoted relative to the support bar of the head plate by one of the two second elastic swivel devices, so that the head plate has a pivotable function.

A further objective of the present invention is to provide a multi-stage backrest assembly, wherein the crossbar of the waist plate is pivoted relative to the support bar of the waist plate by the other one of the two second elastic swivel devices, so that the waist plate has a pivotable function.

In accordance with the present invention, there is provided a multi-stage backrest assembly, comprising a support frame, a back plate, a head plate, a waist plate, a first elastic swivel device, and two second elastic swivel devices, wherein:

the back plate is mounted on the support frame;

the head plate is mounted on the support frame and includes a support bar, and a head frame pivotally mounted on an upper end of the support bar by one of the two second elastic swivel devices; and the waist plate is attached to the back plate and includes a support bar having a bent first end pivotally mounted on the back plate by the first elastic swivel device, and a waist frame pivotally mounted on a second end of the support bar by the other one of the two second elastic swivel devices.

Further benefits and advantages of the present invention will become apparent after a careful reading of the detailed description with appropriate reference to the accompanying drawings.

DETAILED DESCRIPTION OF THE INVENTION

Figure 1:
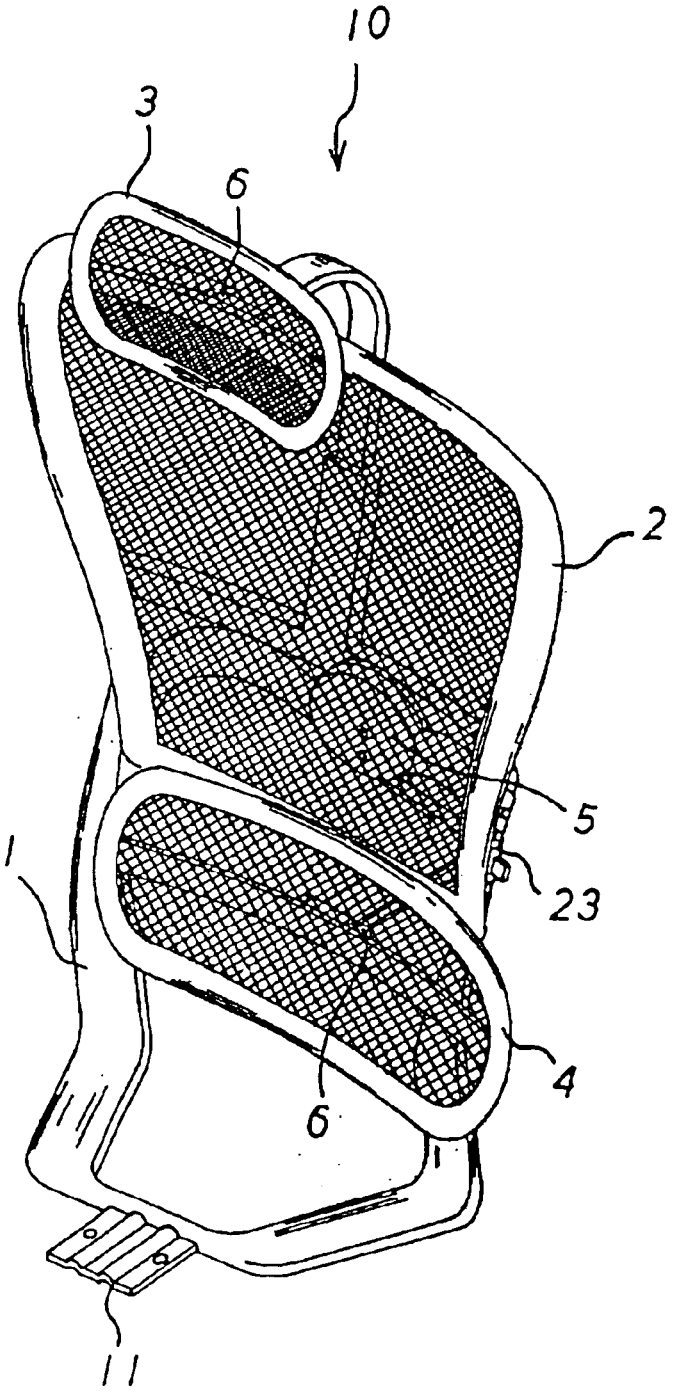
FIG. 1 is perspective view of a multi-stage backrest assembly in accordance with the preferred embodiment of the present invention.

Referring to the drawings and initially to FIGS. 1–5, a multi-stage backrest assembly 10 for a chair in accordance with the preferred embodiment of the present invention comprises a support frame 1, a back plate 2, a head plate 3, a waist plate 4, a first elastic swivel device 5, and two second elastic swivel devices 6.

The support frame 1 is substantially U-shaped and has two substantially L-shaped sections each having a distal end formed with a support tube 12 formed with a plurality of locking holes 13. The support frame 1 has a mediate portion formed with a fixing plate 11 mounted on a seat 7 (see FIG. 6), so that the multi-stage backrest assembly 10 is mounted on the seat 7.

The back plate 2 is mounted on the support frame 1 and includes a backrest frame 21, a net 22 made of foam material or the like mounted on the backrest frame 21, two locking tubes 23 mounted on two sides of the backrest frame 21 and each mounted on the respective support tube 12 of the support frame 1, two crossbars 26 each mounted on and extended from a respective one of the two locking tubes 23, a mounting shaft 24 mounted between the two crossbars 26, and a torsion spring 25 mounted on the mounting shaft 24 and having a first end secured on the mounting shaft 24.

The mounting shaft 24 of the back plate 2 has an end formed with an arch-shaped positioning flange 241 formed with a locking hole 242, and the first end of the torsion spring 25 is secured in the locking hole 242 of the positioning flange 241 of the mounting shaft 24.

The head plate 3 is mounted on the support frame 1 and includes a substantially inverted T-shaped support rack 35 having a lower end formed with two combination studs 33 each inserted into the respective support tube 12 of the support frame 1, a substantially inverted L-shaped support bar 30 having a lower end mounted on an upper end of the support rack 35, a head frame 31 mounted on an upper end of the support bar 30 by one of the two second elastic swivel devices 6, and a net 32 made of foam material or the like mounted on the head frame 31. Preferably, the head plate 3 further includes a crossbar 34 mounted on the head frame 31 and combined with one of the two second elastic swivel devices 6.

The waist plate 4 is attached to the back plate 2 and includes a substantially inverted V-shaped support bar 43 having a bent first end mounted on the first elastic swivel device 5, a waist frame 41 mounted on a second end of the support bar 43 by the other one of the two second elastic swivel devices 6, and a net 42 made of foam material or the like mounted on the waist frame 41. Preferably, the back plate 2 further includes a crossbar 46 mounted on the waist frame 41 and combined with the other one of the two second elastic swivel devices 6. The first end of the support bar 43 of the waist plate 4 is formed with two screw bores 44.

The first elastic swivel device 5 is mounted on the back plate 2, and includes a casing 51 pivotally mounted on the mounting shaft 24 of the back plate 2, and an end cap 55 mounted on the casing 51 to seal the casing 51 and the mounting shaft 24 of the back plate 2.

The casing 51 has an inside formed with a receiving chamber 52 for mounting the mounting shaft 24 and the torsion spring 25 of the back plate 2. The casing 51 has an end formed with a locking groove 53 for locking a second end of the torsion spring 25 of the back plate 2 by a seal plate 58. The casing 51 has a periphery formed with a plurality of threaded posts 511, the end cap 55 has a periphery formed with a plurality of through holes 551, and the first elastic swivel device 5 further includes a plurality of locking screws 57 each extended through a respective one of the through holes 551 of the end cap 55 and each screwed into a respective one of the threaded posts 511 of the casing 51, so that the end cap 55 is fixed on the casing 51.

The casing 51 has a side formed with a receiving recess 54 for mounting the first end of the support bar 43 of the waist plate 4. The receiving recess 54 of the casing 51 is formed with two screw bores 56 aligning with the two screw bores 44 of the support bar 43 of the waist plate 4, and the first elastic swivel device 5 further includes two locking screws 58 (see FIG. 2) each extended through a respective one of the two screw bores 56 of the casing 51 and each screwed into a respective one of the two screw bores 44 of the support bar 43 of the waist plate 4, so that the waist plate 4 is fixed on the first elastic swivel device 5.

Figure 2:
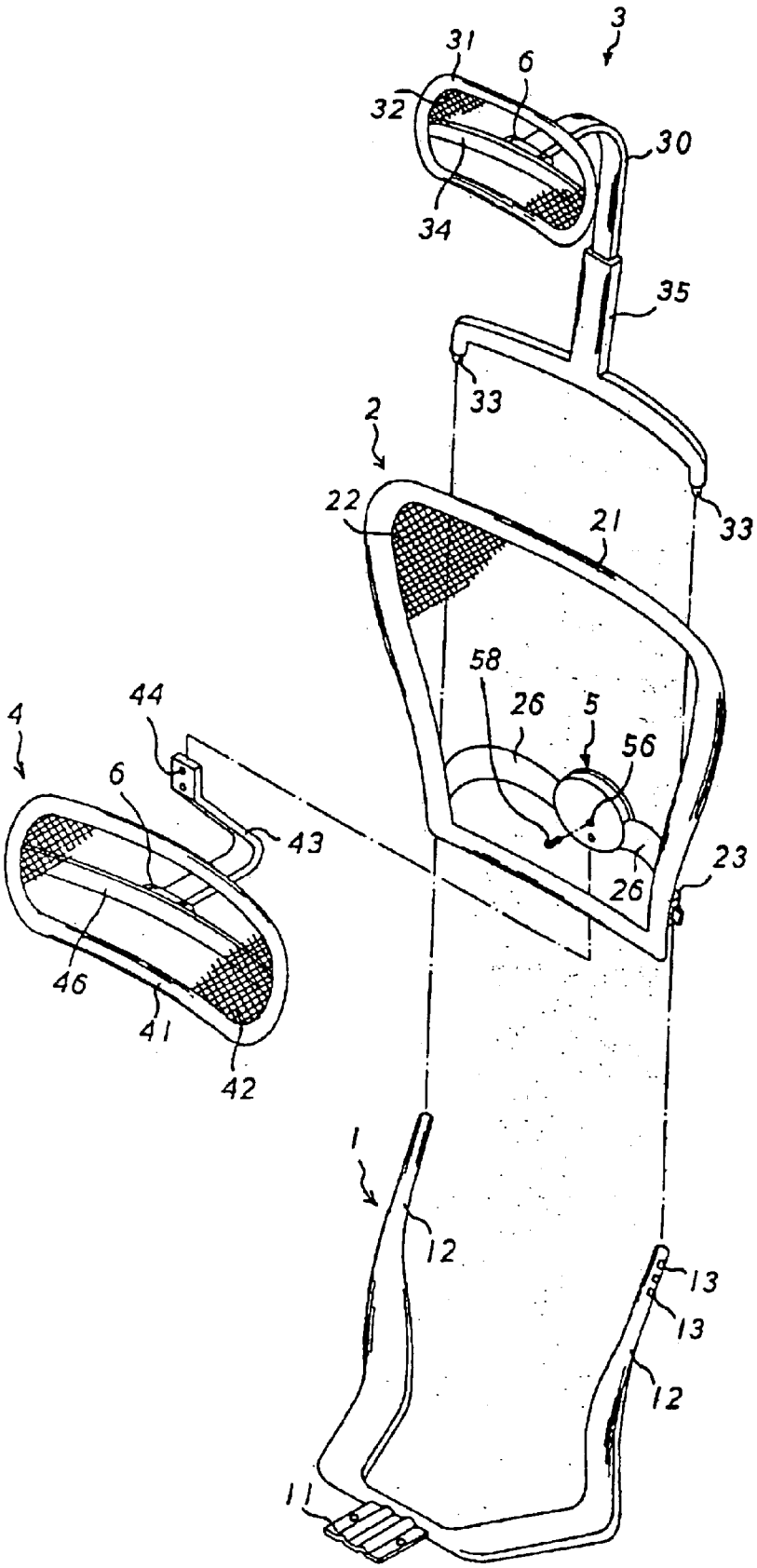
FIG. 2 is a partially exploded perspective view of the multi-stage backrest assembly in accordance with the preferred embodiment of the present invention.
Figure 3:
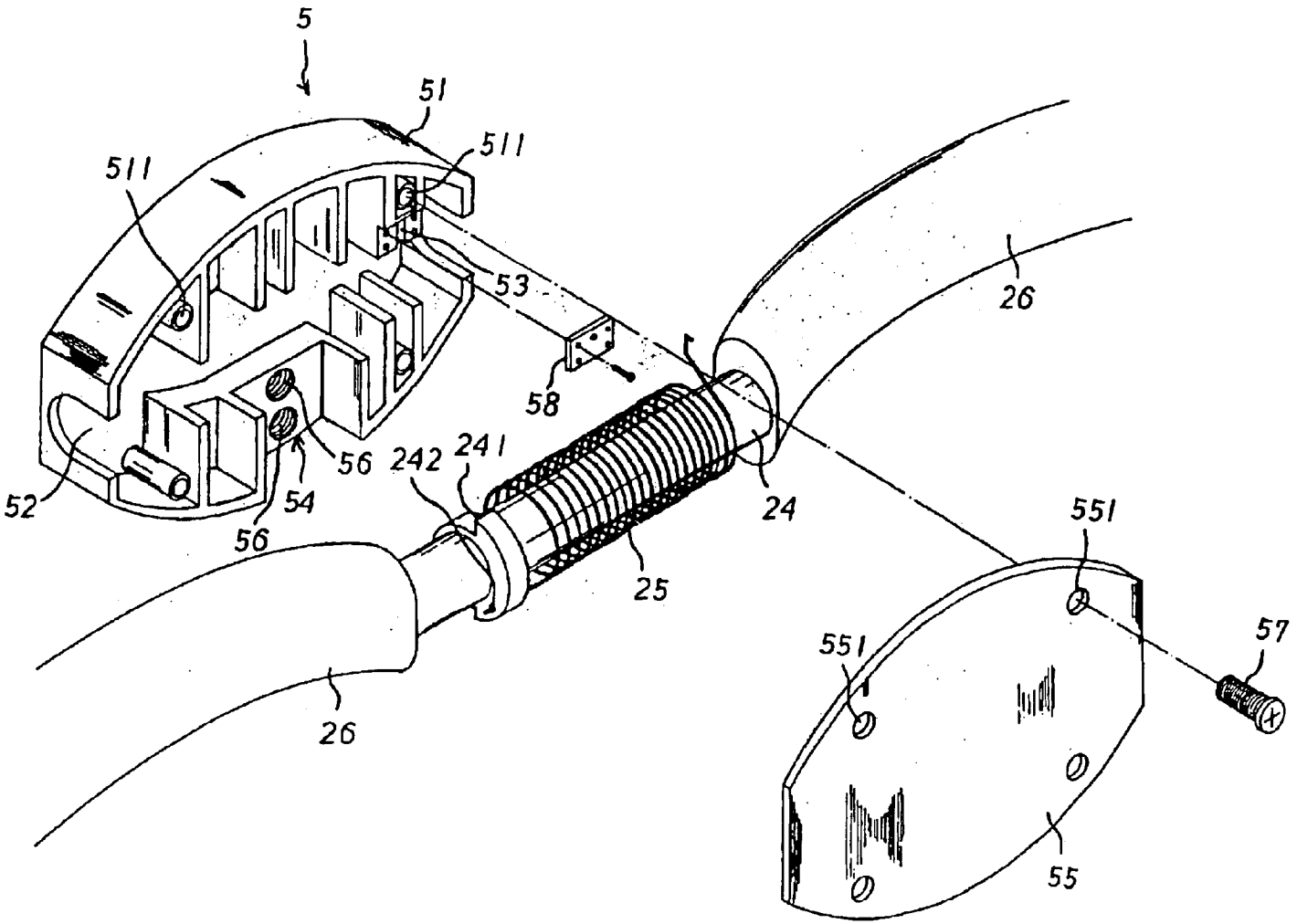
FIG. 3 is a partially exploded perspective view of the multi-stage backrest assembly in accordance with the preferred embodiment of the present invention.
Figure 4:
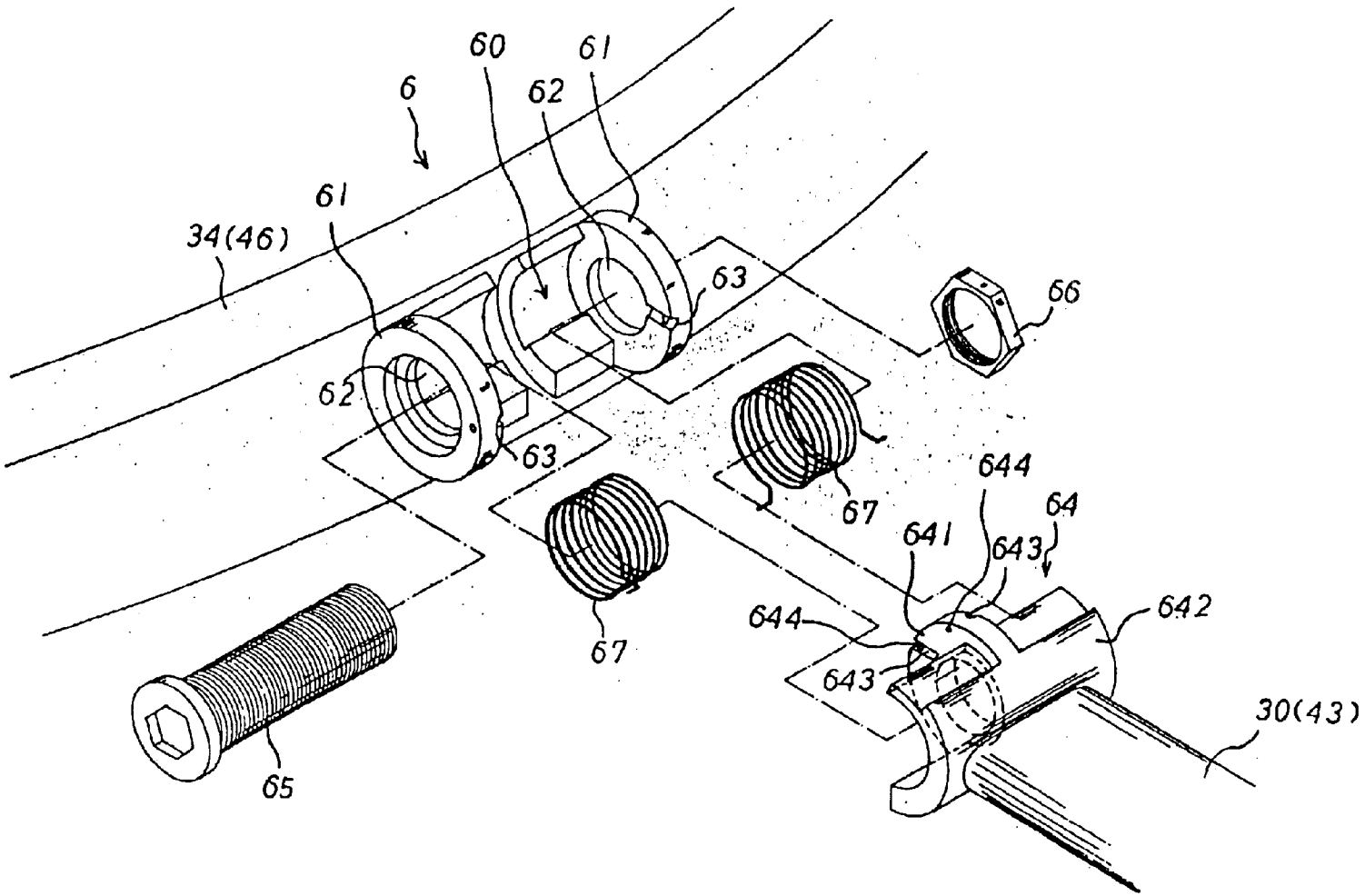
FIG. 4 is a partially exploded perspective view of the multi-stage backrest assembly in accordance with the preferred embodiment of the present invention.
Figure 5:
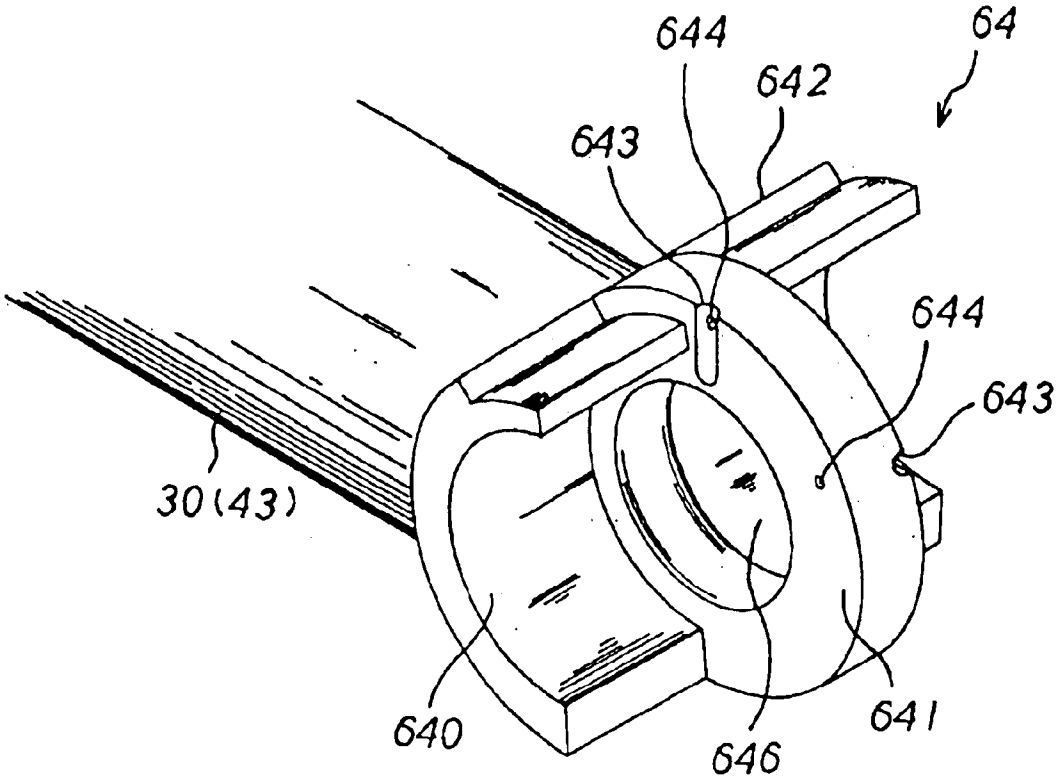
FIG. 5 is a perspective view of a pivot seat of the multi-stage backrest assembly in accordance with the preferred embodiment of the present invention.

Each of the two second elastic swivel devices 6 includes a substantially semi-cylindrical pivot seat 64 secured on the support bar 30 of the head plate 3 or the support bar 43 of the waist plate 4, an support ring 641 mounted on a mediate portion of the pivot seat 64, two rotation members 61 each secured on the crossbar 34 of the head plate 3 or the crossbar 46 of the waist plate 4 as shown in FIG. 2 and each pivotally mounted on the pivot seat 64, and two torsion springs 67 each mounted between the pivot seat 64 and a respective one of the two rotation members 61 and each having a first end secured on the support ring 641 and a second end secured on a respective one of the two rotation members 61.

The pivot seat 64 is formed with a receiving recess 640 for receiving the two torsion springs 67, and each of the two rotation members 61 is formed with a receiving recess 60 for receiving a respective one of the two torsion springs 67. The pivot seat 64 has a periphery formed with an arc-shaped resting plate 642 rested on the two rotation members 61 when the two rotation members 61 are moved to a limit position of the pivot seat 64.

The support ring 641 is formed with a shaft hole 646, each of the two rotation members 61 is formed with a shaft hole 62, and each of the two second elastic swivel devices 6 further includes a threaded rod 65 extended through the shaft hole 62 of each of the two rotation members 61, the two torsion springs 67 and the shaft hole 646 of the support ring 641, and a nut 66 screwed on the threaded rod 65, so that the two rotation members 61 are pivotally mounted on the pivot seat 64.

Each of the two rotation members 61 has a periphery formed with a fixing groove 63, and the second end of each of the two torsion springs 67 is secured in the fixing groove 63 of a respective one of the two rotation members 61, so that the second end of each of the two torsion springs 67 is secured on a respective one of the two rotation members 61.

The support ring 641 is located between the two rotation members 61 and has two sides each formed with a guide slot 643 and a through hole 644 located in the guide slot 643, and the first end of each of the two torsion springs 67 is guided through the respective guide slot 643 and locked in the respective through hole 644 of the support ring 641, so that the first end of each of the two torsion springs 67 is secured on the support ring 641.

Figure 6:
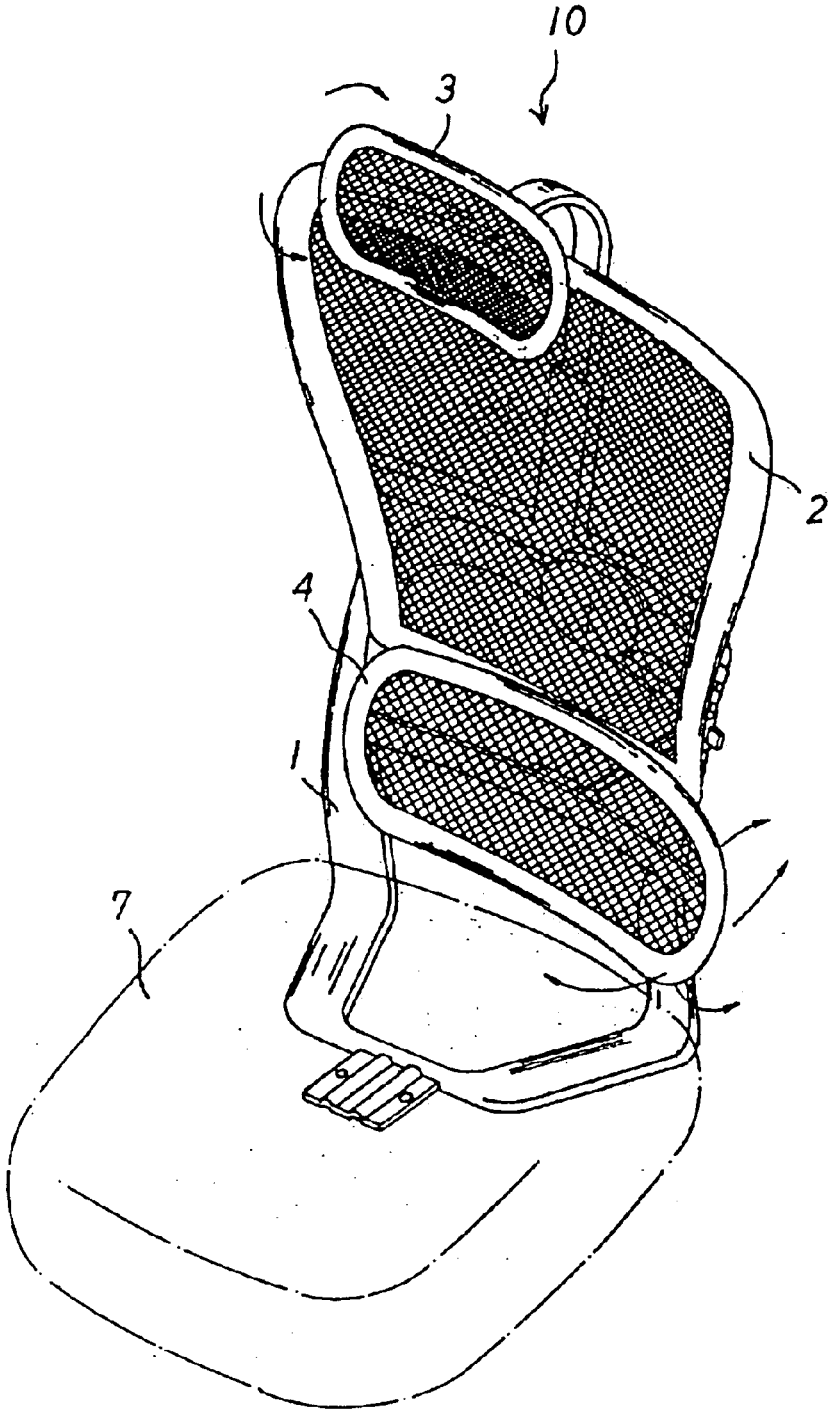
FIG. 6 is a schematic operational view of the multi-stage backrest assembly as shown in FIG. 1 in use.
Figure 7:
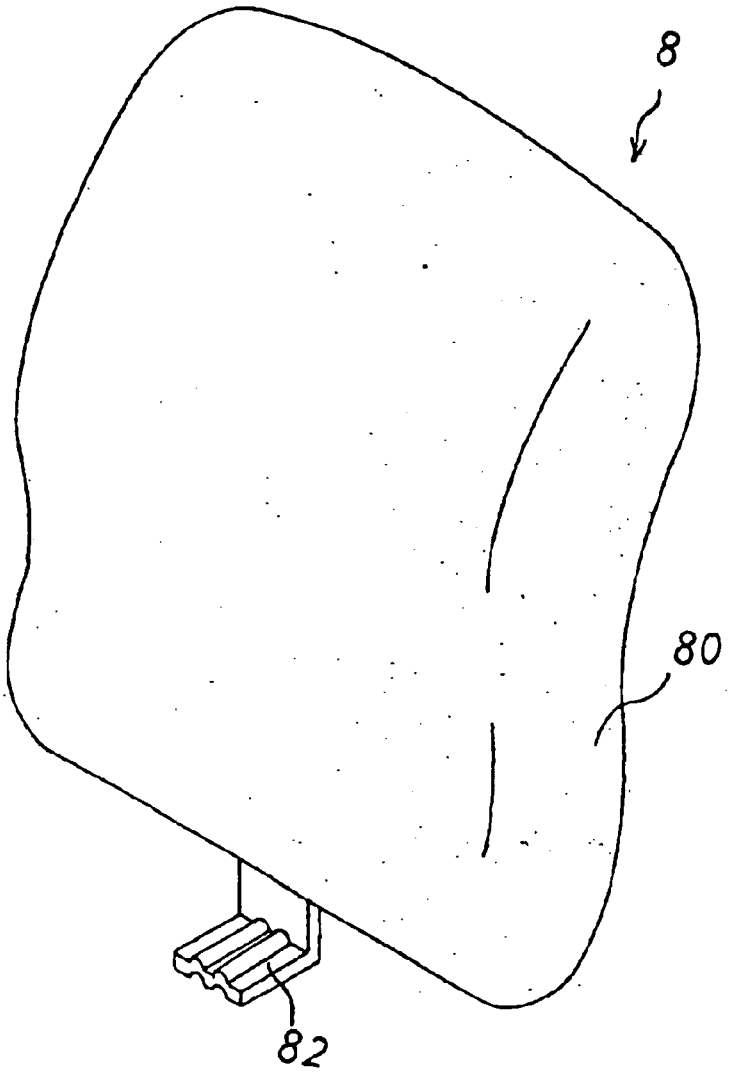
FIG.7 PRIOR ART
FIG. 7 is a perspective view of a conventional backrest in accordance with the prior art.

In operation, referring to FIG. 6 with reference to FIGS. 1–5, the crossbar 34 of the head plate 3 is pivoted relative to the support bar 30 of the head plate 3 by one of the two second elastic swivel devices 6, so that the head plate 3 has a pivotable function. In addition, the crossbar 46 of the waist plate 4 is pivoted relative to the support bar 43 of the waist plate 4 by the other one of the two second elastic swivel devices 6, so that the waist plate 4 has a pivotable function. In addition, the support bar 43 of the waist plate 4 is pivoted relative to the mounting shaft 24 of the back plate 2 by the first elastic swivel device 5, so that the waist plate 4 is pivotable relative to the back plate 2.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A multi-stage backrest assembly, comprising a support frame, a back plate, a head plate, a waist plate, a first elastic swivel device, and two second elastic swivel devices, wherein:

the back plate is mounted on the support frame;

the head plate is mounted on the support frame and includes a support bar, and a head frame pivotally mounted on an upper end of the support bar by one of the two second elastic swivel devices; and the waist plate is attached to the back plate and includes a support bar having a bent first end pivotally mounted on the back plate by the first elastic swivel device, and a waist frame pivotally mounted on a second end of the support bar by the other one of the two second elastic swivel devices.

2. The multi-stage backrest assembly in accordance with claim 1, wherein the back plate includes a backrest frame, two crossbars each mounted on the backrest frame, a mounting shaft mounted between the two crossbars, and a torsion spring mounted on the mounting shaft and having a first end secured on the mounting shaft.

3. The multi-stage backrest assembly in accordance with claim 2, wherein the first elastic swivel device is mounted on the back plate, and includes a casing pivotally mounted on the mounting shaft of the back plate, and an end cap mounted on the casing to seal the casing and the mounting shaft of the back plate.

4. The multi-stage backrest assembly in accordance with claim 3, wherein the casing has an inside formed with a receiving chamber for mounting the mounting shaft and the torsion spring of the back plate.

5. The multi-stage backrest assembly in accordance with claim 3, wherein the casing has an end formed with a locking groove for locking a second end of the torsion spring of the back plate by a seal plate.

6. The multi-stage backrest assembly in accordance with claim 3, wherein the casing has a periphery formed with a plurality of threaded posts, the end cap has a periphery formed with a plurality of through holes, and the first elastic swivel device further includes a plurality of locking screws each extended through a respective one of the through holes of the end cap and each screwed into a respective one of the threaded posts of the casing, so that the end cap is fixed on the casing.

7. The multi-stage backrest assembly in accordance with claim 3, wherein the first end of the support bar of the waist plate is formed with two screw bores, the casing has a side formed with a receiving recess for mounting the first end of the support bar of the waist plate, the receiving recess of the casing is formed with two screw bores aligning with the two screw bores of the support bar of the waist plate, and the first elastic swivel device further includes two locking screws each extended through a respective one of the two screw bores of the casing and each screwed into a respective one of the two screw bores of the support bar of the waist plate.

8. The multi-stage backrest assembly in accordance with claim 2, wherein the mounting shaft of the back plate has an end formed with an arch-shaped positioning flange formed with a locking hole, and the first end of the torsion spring is secured in the locking hole of the positioning flange of the mounting shaft.

9. The multi-stage backrest assembly in accordance with claim 1, wherein each of the two second elastic swivel devices includes a substantially semi-cylindrical pivot seat secured on the support bar of the head plate or the support bar of the waist plate, an support ring mounted on a mediate portion of the pivot seat, two rotation members each secured on the head frame of the head plate or the waist frame of the waist plate and each pivotally mounted on the pivot seat, and two torsion springs each mounted between the pivot seat and a respective one of the two rotation members and each having a first end secured on the support ring and a second end secured on a respective one of the two rotation members.

10. The multi-stage backrest assembly in accordance with claim 9, wherein the pivot seat is formed with a receiving recess for receiving the two torsion springs, and each of the two rotation members is formed with a receiving recess for receiving a respective one of the two torsion springs.

11. The multi-stage backrest assembly in accordance with claim 9, wherein the pivot seat has a periphery formed with an arc-shaped resting plate rested on the two rotation members when the two rotation members are moved to a limit position of the pivot seat.

12. The multi-stage backrest assembly in accordance with claim 9, wherein the support ring is formed with a shaft hole, each of the two rotation members is formed with a shaft hole, and each of the two second elastic swivel devices further includes a threaded rod extended through the shaft hole of each of the two rotation members, the two torsion springs and the shaft hole of the support ring, and a nut screwed on the threaded rod, so that the two rotation members are pivotally mounted on the pivot seat.

13. The multi-stage backrest assembly in accordance with claim 9, wherein the each of the two rotation members has a periphery formed with a fixing groove, and the second end of each of the two torsion springs is secured in the fixing groove of a respective one of the two rotation members, so that the second end of each of the two torsion springs is secured on a respective one of the two rotation members.

14. The multi-stage backrest assembly in accordance with claim 9, wherein the support ring is located between the two rotation members and has two sides each formed with a guide slot and a through hole located in the guide slot, and the first end of each of the two torsion springs is guided through the respective guide slot and locked in the respective through hole of the support ring, so that the first end of each of the two torsion springs is secured on the support ring.

15. The multi-stage backrest assembly in accordance with claim 1, wherein the support frame is substantially U-shaped and has two substantially L-shaped sections each having a distal end formed with a support tube formed with a plurality of locking holes, the back plate includes a backrest frame, a net mounted on the backrest frame, and two locking tubes mounted on two sides of the backrest frame and each mounted on the respective support tube of the support frame, and the head plate includes a substantially inverted T-shaped support rack having a lower end formed with two combination studs each inserted into the respective support tube of the support frame.

16. The multi-stage backrest assembly in accordance with claim 15, wherein the support bar of the head plate is substantially inverted L-shaped and has a lower end mounted on an upper end of the support rack.

17. The multi-stage backrest assembly in accordance with claim 1, wherein the head plate further includes a net mounted on the head frame, and a crossbar mounted on the head frame and combined with one of the two second elastic swivel devices.

18. The multi-stage backrest assembly in accordance with claim 1, wherein the waist plate further includes a net mounted on the waist frame, and a crossbar mounted on the waist frame and combined with the other one of the two second elastic swivel devices.

19. The multi-stage backrest assembly in accordance with claim 1, wherein the support bar of the waist plate is substantially inverted V-shaped.

20. The multi-stage backrest assembly in accordance with claim 1, wherein the support frame has a mediate portion formed with a fixing plate 11 mounted on a seat.

* * * * *